US007340919B2

(12) United States Patent
Sami et al.

(10) Patent No.: US 7,340,919 B2
(45) Date of Patent: Mar. 11, 2008

(54) METHOD AND APPARATUS FOR ENHANCING HEAT PUMP AND REFRIGERATION EQUIPMENT

(75) Inventors: Samuel Sami, Ottsville, PA (US); Peter A Kulish, New Hope, PA (US); Ronald J Kita, Doylestown, PA (US); Garrett J Shivo, Warren, VT (US)

(73) Assignee: Magnetizer Industrial Technologies, Inc., Fountainville, PA (US)

( * ) Notice: Subject to any disclaimer, the term of this patent is extended or adjusted under 35 U.S.C. 154(b) by 275 days.

(21) Appl. No.: 10/518,438

(22) PCT Filed: Nov. 14, 2003

(86) PCT No.: PCT/US03/36643

§ 371 (c)(1),
(2), (4) Date: Dec. 16, 2004

(87) PCT Pub. No.: WO2004/046620

PCT Pub. Date: Jun. 3, 2004

(65) Prior Publication Data

US 2005/0268620 A1 Dec. 8, 2005

Related U.S. Application Data

(60) Provisional application No. 60/426,302, filed on Nov. 14, 2002.

(51) Int. Cl.
*F25B 1/00* (2006.01)
*F25B 21/00* (2006.01)

(52) U.S. Cl. ..... 62/498; 62/3.1

(58) Field of Classification Search ..... 62/3.1, 62/467, 498
See application file for complete search history.

(56) References Cited

U.S. PATENT DOCUMENTS

| | | | | |
|---|---|---|---|---|
| 3,070,971 | A * | 1/1963 | Jacobs | 62/78 |
| 5,024,059 | A * | 6/1991 | Noble | 62/3.1 |
| 5,177,970 | A * | 1/1993 | Chang | 62/3.1 |
| 6,397,619 | B1 * | 6/2002 | Cheng et al. | 62/272 |
| 6,662,569 | B2 * | 12/2003 | Sami et al. | 62/3.1 |
| 2004/0007000 | A1 * | 1/2004 | Takeda et al. | 62/78 |

* cited by examiner

*Primary Examiner*—William C Doerrler
(74) *Attorney, Agent, or Firm*—Stephen H. Eland; Dann, Dorfman, Herrell and Skillman

(57) ABSTRACT

A vapor compression apparatus and a method for operating a vapor compression system are provided. A working fluid is conveyed through a vapor compression system having a fluid line. A charging element is connected to the fluid line to direct an electric charge into working fluid. The electric charge is operable to disrupt intermolecular forces and weaken intermolecular attraction to enhance expansion of the working fluid to the vapor phase, increasing the capacity, performance and efficiency of the system components, and reducing system cycling mechanical wear and energy consumption.

26 Claims, 4 Drawing Sheets

METHOD AND APPARATUS FOR ENHANCING HEAT PUMP AND REFRIGERATION EQUIPMENT

RELATED APPLICATIONS

This application claims priority under 35 U.S.C. § 119 to U.S. Provisional Application No. 60/426,302 filed Nov. 14, 2002 which is hereby incorporate herein by reference.

FIELD OF THE INVENTION

The present invention relates to vapor compression systems, and more specifically to a vapor compression apparatus with a charging element for electrically stimulating the refrigerant, and a method for enhancing the performance of heat pump and refrigeration equipment and the efficiency of vapor compression systems.

BACKGROUND

In the present state of the art, vapor compression systems are used in a number of applications to cool an environment. Vapor compression is used in air conditioners, refrigerators, freezers, blast freezers and other cooling systems. Cooling is achieved by evaporating a refrigerant or refrigeration media under reduced pressure to lower the temperature of the refrigerant and absorb heat from an environment.

In conventional vapor compression systems, refrigerants or refrigerant mixtures with low boiling points are used as the working fluid. The refrigerant is pumped to a compressor which elevates the temperature and pressure of the refrigerant. The hot refrigerant is discharged to a first heat exchanger, or condenser, to remove heat from the refrigerant. As heat is removed in the condenser at elevated pressure, the refrigerant converts to the liquid phase. The refrigerant is then conveyed to an expansion valve that rapidly reduces the pressure of the refrigerant. The rapid pressure reduction causes the refrigerant to flash into a liquid and vapor mixture having a very low temperature. The refrigerant is discharged to a second heat exchanger, or evaporator, where the refrigerant absorbs heat. The added heat converts a substantial portion of the remaining liquid phase to the vapor phase. The refrigerant is cycled back to the compressor, where the foregoing process is repeated.

A significant problem with present vapor compression systems is the excessive cost of operation. Vapor compression consumes a significant amount of energy. Energy efficiency in vapor compression systems is often limited by incomplete or inefficient evaporation and condensation of the refrigerant. When evaporation is incomplete, some of the refrigerant enters the compressor shell in the liquid phase. The compressor must consume additional energy to boil the liquid refrigerant that enters the compressor shell. This reduces the coefficient of performance (COP) of system components and overall efficiency of the system.

SUMMARY OF THE INVENTION

In a first aspect of the present invention, a vapor compression apparatus is provided that efficiently evaporates a working fluid to cool an environment. A compressor is operable to increase the pressure and temperature of the working fluid. The system also includes a condenser that is operable to absorb heat from the working fluid. An expansion valve is operable to decrease the pressure of the working fluid. An evaporator is operable to transfer heat to the working fluid, and a charging element is operable to apply an electric charge to the working fluid.

In another aspect of the invention, a refrigeration system is provided that includes a working fluid operable to absorb heat, a fluid path comprising a conduit through which the work flows, and a triboelectric charging element positioned along the fluid path so that the working fluid flows over a surface of the charging element. The charging element is formed of a material having a triboelectric working function that is substantially different than the triboelectric working function of the working fluid, so that the working fluid is triboelectrically charged by flowing over the charging element.

In another aspect of the present invention, a method for operating a vapor compression system is provided. A working fluid is compressed to elevate the pressure and temperature of the working fluid. The working fluid is discharged to a condenser to release heat from the working fluid and convert the fluid to a liquid phase. The working fluid is discharged from the condenser to an expansion device to convert the working fluid to a vapor phase. The working fluid is discharged from the expansion device and heat is transferred to the working fluid. In addition, an electrical charge is applied to the working fluid to improve the efficiency of the process The present invention may be constructed and operated without the need for a highly skilled technician. In operation, the present invention increases the cooling capacity and COP of the evaporator. Specifically, the present invention improves the expansion of the working fluid in the evaporator, thereby improving the efficiency of the overall system. The enhanced performance of the system and reduced cycling lowers overall power consumption in the system, conserving energy and lowering greenhouse gas emissions to the environment.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
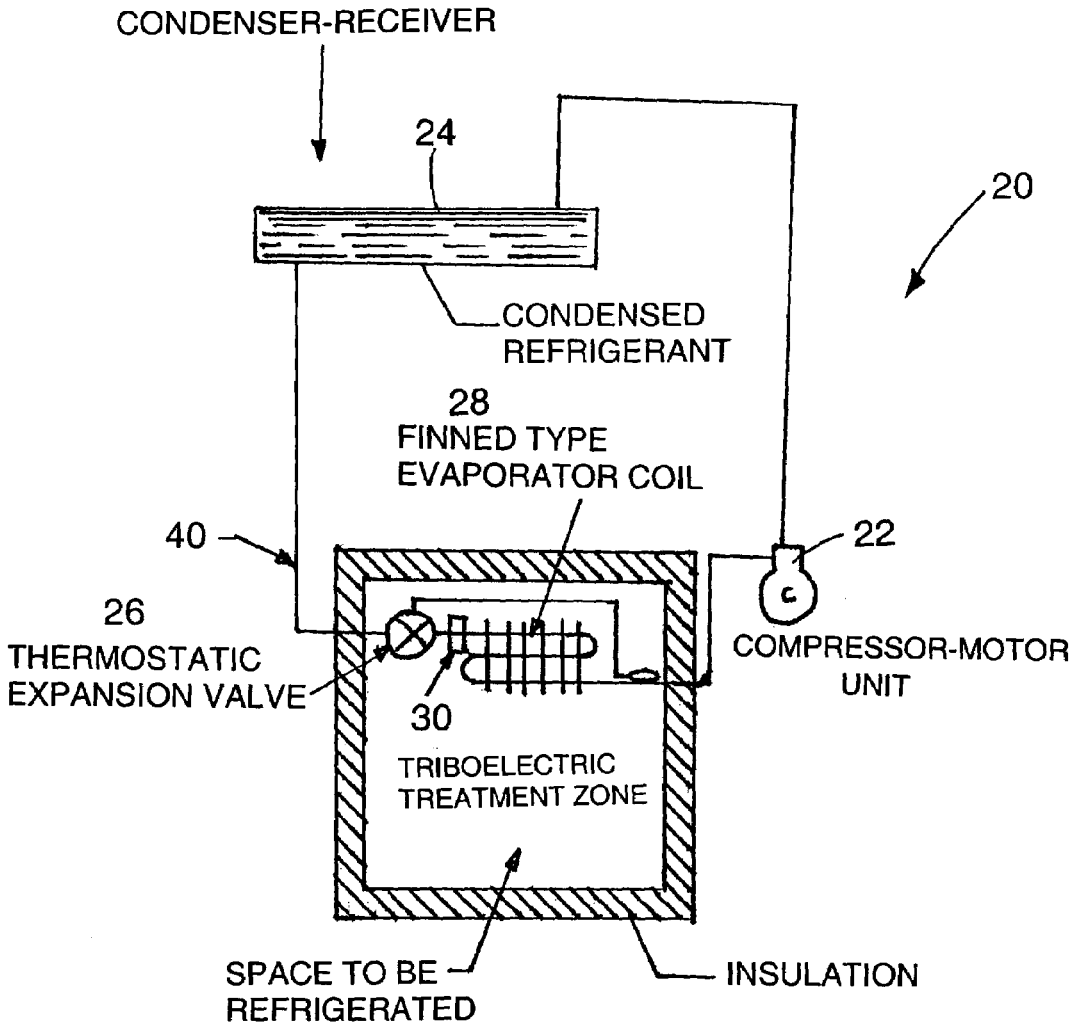
FIG. 1 is a block diagram of a refrigeration system embodying aspect of the present invention.

Referring to FIGS. 1-4 in general, and to FIG. 1 specifically, a schematic view of a vapor compression system in accordance with the present invention is shown and designated generally as 20. The system 20 is operable to condense and evaporate a working fluid which flows through the system. A magnetic field is generated through the working fluid to enhance the coefficient of performance and energy efficiency of the system 20.

The vapor compression system 20 comprises a compressor 22, a condenser 24, an expansion valve 26 and an evaporator 28. Depending on operating conditions, the system 20 may also incorporate other components used in vapor compression, including but not limited to a pre-condenser, post-condenser, pre-evaporator, post-evaporator, reversing valve, suction accumulator, and other components. The system 20 may use any type of heat exchanger in the condenser 24 and evaporator 28, including but not limited to refrigerant/air, refrigerant/water or refrigerant/anti-freeze exchangers.

A charging element 30 is connected to the system to apply an electric charge to the working fluid. The electric charge is applied to the working fluid in the liquid phase to disrupt intermolecular forces in the working fluid and enhance expansion of the working fluid molecules. This reduces the amount of residual liquid that is boiled in the compressor shell, lowering the power consumption of the compressor and improving the overall efficiency of the system. The direction of flow of the working fluid in the system 20 is represented by the arrows in FIG. 1.

The system 20 is intended to enhance the performance of a number of working fluids in vapor compression systems, including but not limited to pure refrigerants and multi-component HFC mixtures. The type of working fluid is dependent on, among other things, the desired application and operating temperatures for the condenser and evaporator. The present invention may enhance performance of working fluids at condenser temperatures between 20° C. and 90° C., and evaporator temperatures between −85° C. and 25° C. The system 20 may be used with any pure refrigerant or refrigerant mixture, including but not limited to R-12, R-22, R-502, R-11, R-114, R-134a, R-507 (R-125/R-143a:50/50%), R-404A (R-125/R-143a/R-134a:44/52/4%), R-410A (R-32/R-125:50/50%), and R-407C (R-32/R-125/R-134a:23/25/52%). In addition, ammonia methane, ethane, propane, butane, pentane and carbon dioxide may be used as working fluids in the present invention. The foregoing list of refrigerants represents just some of the possible refrigerants that may be used, and is not intended to be exhaustive or exclude other refrigerants not explicitly mentioned. In the description that follows, the system 20 will be described simply as using a refrigerant, with the understanding that this may include a variety of pure refrigerants, multi-component HFC refrigerant mixtures, and other working fluids suitable for different applications.

Preferably the refrigerant is a multi-component HFC refrigerant mixture, and ternary refrigerant mixtures are most preferred. However, binary mixtures and pure refrigerants such as R-134A may also be used. Alternatively, the system may use R-404A and R-410A refrigerant mixtures.

Figure 2:
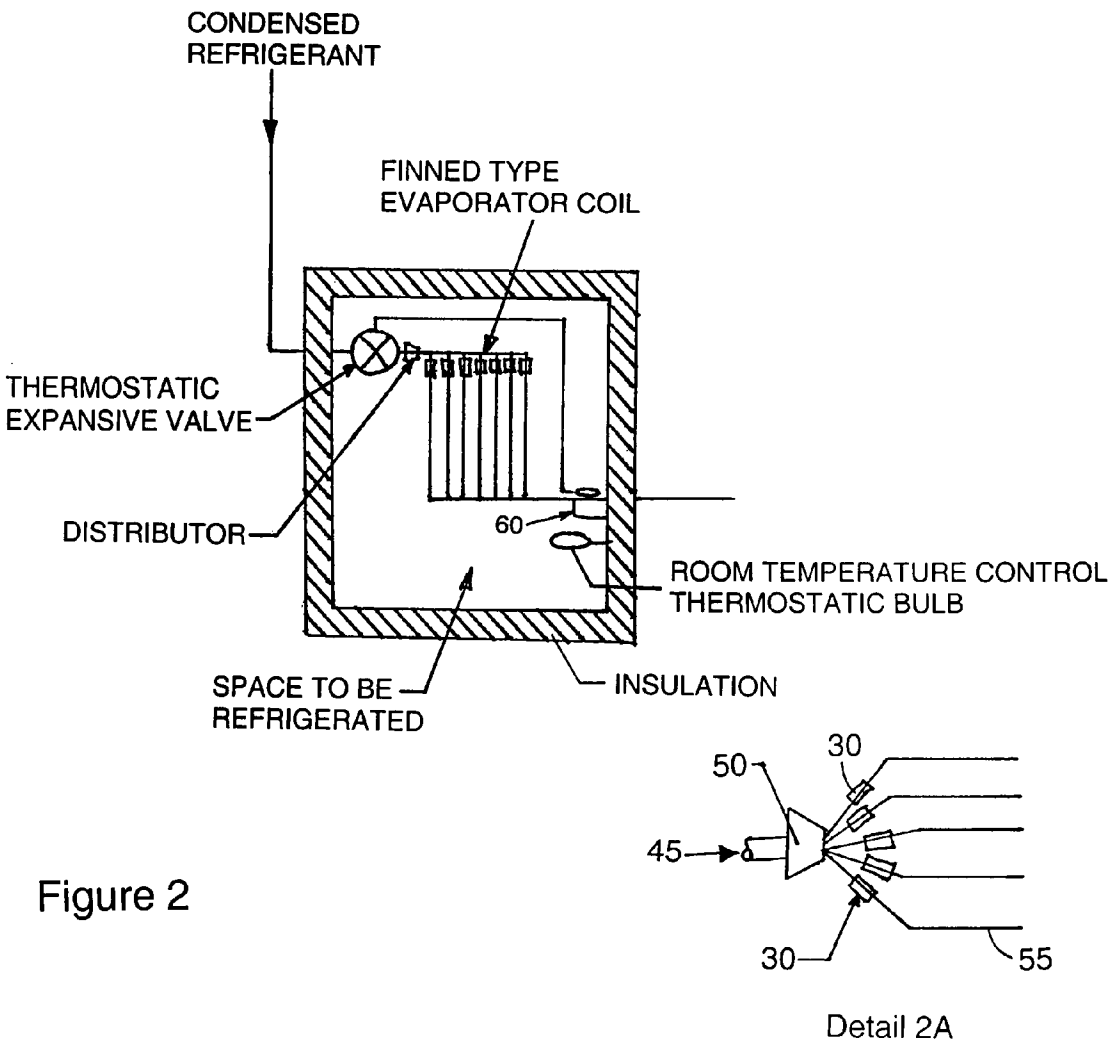
FIG. 2 is a section of the system illustrated in FIG. 1 detailing an implementation of a triboelectric dielectric material.

Referring now to FIGS. 1-2, the system 20 will be described in greater detail. The system 20 is a closed loop system, in which the refrigerant is recycled. A fluid line 40 connects the compressor 22, condenser 24, expansion valve 26 and evaporator 28 in the closed loop.

The charging element may comprise a conductive element that provides an electrical charge from an external source. However, preferably the charging element is operable to triboelectrically charge the working fluid. Triboelectric effects are experienced when electrostatically different materials are rubbed or come in physical contact with each other. For instance, the rubbing of silk material of a glass rod has been known to the scientific community for centuries as a triboeictric or electrostatic producing effect. The triboelectric working function of a material relates to the tendency to appropriate electrons from other materials. More specifically, a material that has a higher work function than a second material will tend to appropriate electrons from the second material when the two materials are brought into contact. The effect is increased when the two elements are rubbed together. Still further, the greater the dissimilarity between the working function of two materials, the greater the triboelectric effect.

Although not exhaustive, the following list ranks a series of elements from most likely to give up an electron to least likely. The element at the top of the list has the lowest work function, the element at the bottom of the list has the highest work function.

Dry human skin
Asbestos
Leather
Rabbit fur
Acetate
Glass
Human hair
Nylon
Wool
Lead
Silk
Aluminum
Paper
Cotton
Steel
Wood
Amber
Sealing wax
Hard rubber
MYLAR
Nickel, Copper
Brass, Silver
Gold, Platinum
Sulfur
Polyester
Celluloid
Styrene (Styrofoam)
Orion
Acrylic
Saran Wrap
Polyurethane
Polyethylene (like Scotch Tape)
Polypropylene
Vinyl (PVC)
Silicon
Teflon
Silicon Rubber In other words, the further apart two elements are from one another along the Triboelectric series shown in the list above, the greater the triboelectric effect (i.e. the greater the triboelectric charging).

According to the chart the highest electrostatic generating capabilities come from selecting materials near the ends of the series. Glass and teflon are materials that are capable of generating high triboelectric effect when frictional contact is made. It should be noted that teflon is basically a polymerized refrigerant gas and that teflon and CFC and HFC refrigerant mixtures have this common chemical origin.

In order to generate the maximum charge on a refrigerant or working fluid, it is advisable to select materials from the extreme positions of Triboelectric chart. The triboelectric chart represents a sample of dissimilar materials, but it should not be construed as a comprehensive list. As an example, glass used in combination with a Refrigerant of CFC, HCFC or HFC origin is chosen. Other materials with the same work function can be chosen. Another example would be Asbestos in connection with a CFC, HCFC or HFC refrigerant. The use of materials with similar charge properties is not desirable (e.g. Teflon and silicon rubber) since they possess similar electric properties.

The effect of electrostatically charging a fluid can result in altering or disrupting the intermolecular forces of the refrigerant as well as providing greater thermal heat transfer through the full use of the latent heat of evaporation. Electrostatically voltages generated by such means can exceed 70 Kilo-Volts or more. Each single triboelectric generating station produces electrostatic charges causing a mutual repulsion between molecules and reduces the covalent bonds between the molecules. This in turn, reduces the Van de Wales forces that bond the refrigerant molecules and increases the rate of nucleation and bubble generation of refrigerant vapor subject to boiling.

In FIG. 1, a block diagram of a refrigeration system is provided and FIG. 2 shows the possible position of triboelectric generating stations.

In order to create an electrostatic charge on the refrigerant molecule, a charging element, such as a glass sleeve or Positive End of Series PES (materials with lower work function) serves as the triboelectric material. The choice of PES depends upon the many parameters including but not limited to type of the refrigerant, chemical composition, electrical properties and friction factors. A glass sleeve is desired since the glass is not only capable of rendering the refrigerant charged as the fluid passes through, but it also serves as a dielectic union. The charging element may be an insert positioned within the conduit through which the refrigerant flows. Alternatively, the charging element may be in-line with the conduit. In other words, the conduit abuts the charging element and the charging element is essentially a section along the length of the conduit. Configured in this way, the conduit would appear as a length of conduit, the a length of glass (or other material) and then another length of conduit.

As refrigerant 45 passes over or through the triboelectric element a charge is generated. The glass also reduces pressure drop of refrigerant across the triboelectric element. If the conduit is formed of a conductive material, such as a metal, it may be desirable to utilize an insulating element adjacent the triboelectric element; More specifically, by charging the working fluid, there may be a tendency for the charge to create sparking between the working fluid and the conduit if the conduit is conductive. Accordingly, preferably the insulating element is formed of a material that has a similar or substantially similar triboelectric working function as the working fluid. In this way, the triboelectric charging does not increase as the working fluid passes over or through the insulating element. As with the triboelectric element, the insulating element may be disposed within the conduit (like a liner) or the insulating element can be in-line with the conduit.

Figure 3:
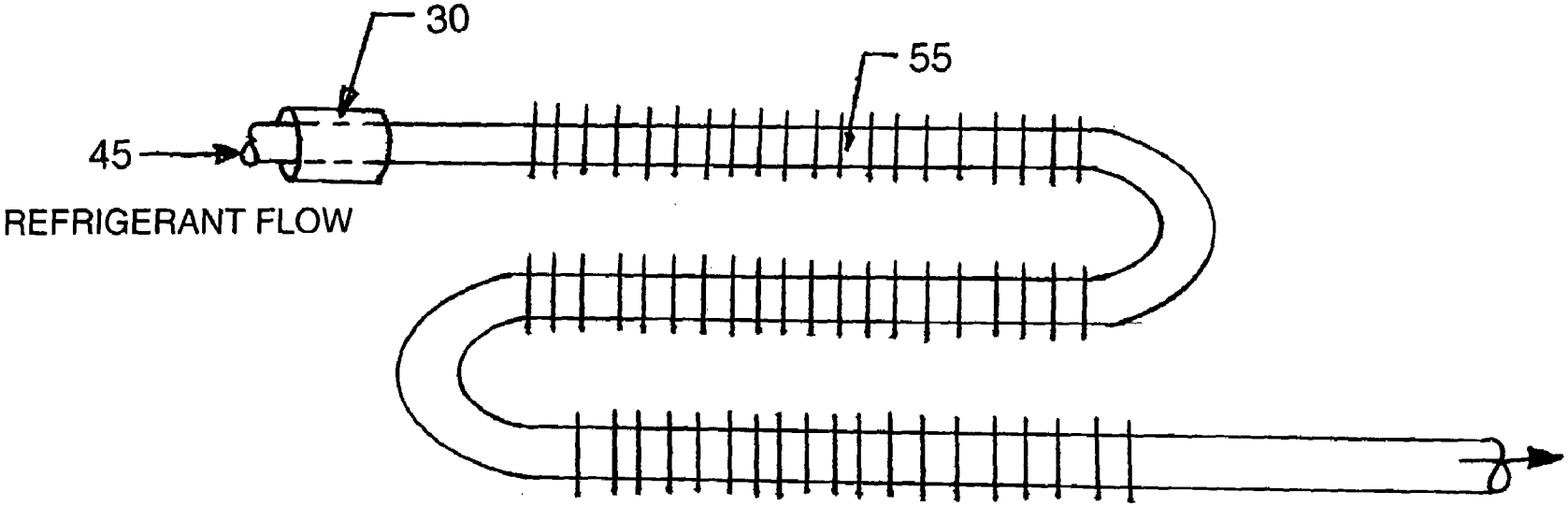
FIG. 3 illustrates possible location of the triboelectric generating station on an evaporator circuit.

The triboelectric elements can be installed at any point of the heat exchanger to enhance the thermal capacity. However, it is most advantageous to have the triboelectric generating section located after the heat exchanger distributor 50 at the inlet to the heat exchanger as the refrigerant enters the evaporator circuits 55. Evaporators have many circuits and each circuit acts as an evaporating length as shown in FIG. 3.

Figure 4:
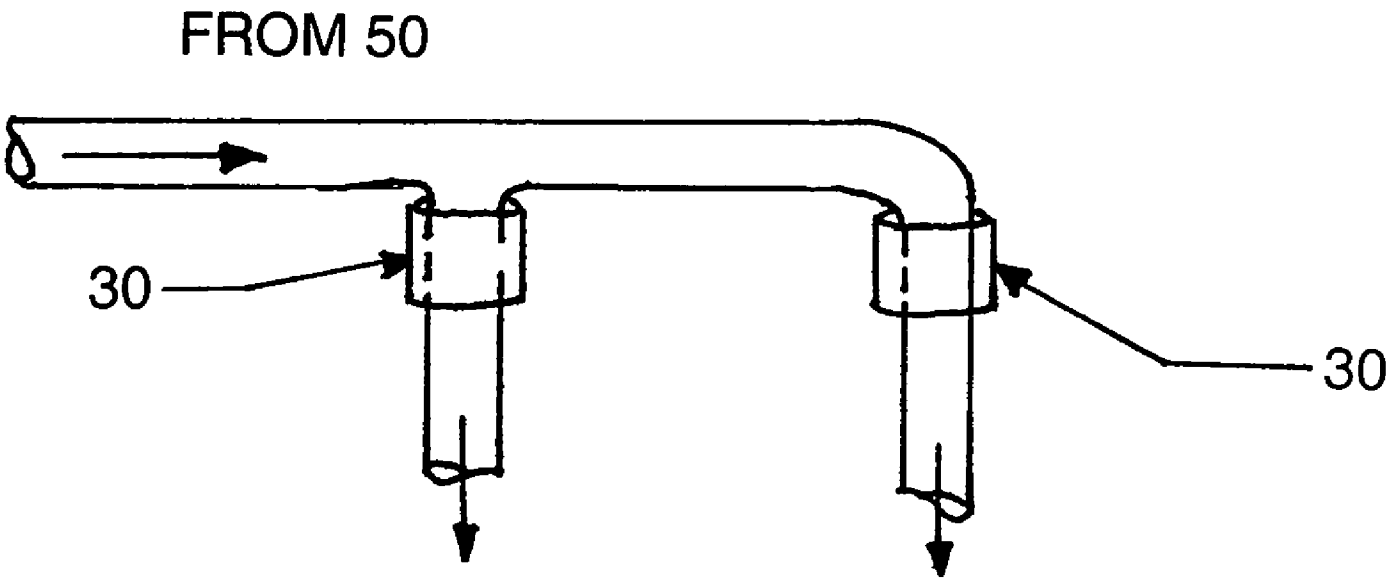
FIG. 4 illustrates refrigerant lines from refrigerant distributor to evaporator circuits with electrostatic triboelectric union.

Electrostatic charges in the refrigerant or refrigerant mixture passing through the sleeve as presented in FIG. 4 and enhances rate of nucleation, heat transfer rate, heat flux and increases the thermal capacity of the heat exchanger thus increasing the cooling capacity. This in turn reduces compressor power, enhances the system performance and coefficient of performance. Other benefits include but not limited to increase of compressor life span and less system maintenance.

Accordingly, it may be desirable to locate other dielectric sections 30 at various distances along the heat exchanger evaporator length depending upon various design parameters including but not limited to the length of the heat exchanger and the boiling point of the refrigerant. The use of various triboelectric stations will enhance the rate of nucleation along the boiling length of the evaporator and reduce the liquid refrigerant that is carried over to the compressor chamber.

The aforementioned series of dielectric unions electrostatically isolates the evaporator from the rest of the refrigeration equipment since only the evaporator is electrostatically charged. In FIG. 2 a grounding strap 60 is located at the end of the evaporator section 55. This allows the charges to dissipate after the tribolectric charge as the refrigerant passes through the final section of the evaporator to the compressor.

The triboelectric generating stations can be used for other types air and liquid cooled heat exchangers where boiling takes place in many applications including but not limited to refrigeration, air conditioning, freezing, blast freezing, heating, steam boilers, waste heat boilers, co-generation systems and combined cycles.

The triboelectric unions will be placed at the entrance to the heat exchangers evaporating lengths or/and circuits. At certain applications it is also advantageous to use more than one triboelectric union in the heat exchanger circuits. The net benefit of the use of triboelectric in the aforementioned applications is to enhance the thermal capacity, the performance of equipment and to reduce specific fuel consumption rate of equipment.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

We claim:

1. A vapor compression system for use with a working fluid, comprising:

a compressor operable to increase the pressure and temperature of the working fluid;

a condenser operable to absorb heat from the working fluid;

an expansion valve operable to decrease the pressure of the working fluid;

an evaporator operable to transfer heat to the working fluid;

a charging element operable to apply an electric charge to the working fluid; and an insulating element positioned adjacent the charging element wherein the insulating element is formed of a material having a triboelectric working function that is similar to the triboelectric working function of the working fluid.

2. The vapor compression system of claim 1 wherein the charging element is formed of a material that has a triboelectric working function that is substantially different than the triboelectric working function of the working fluid.

3. The vapor compression system of claim 1 wherein the charging element is positioned so that the working fluid flows over a surface of the charging element.

4. The vapor compression system of claim 3 wherein the charging element is configured so that flowing the working fluid over the charging element is operable to triboelectrically charge the working fluid.

5. The vapor compression system of claim 1 comprising a fluid path through which the working fluid flows, wherein the charging element is positioned within the fluid path.

6. The vapor compression system of claim 1 wherein the charging element is formed of glass.

7. The vapor compression system of claim 1 wherein the charging element is formed of a non-metallic material.

8. The vapor compression system of claim 1 comprising a fluid path through which the working fluid flows, wherein the charging element is positioned along the fluid path between the expansion valve and the compressor.

9. The vapor compression system of claim 1 wherein the evaporator comprises an inlet and the charging element is positioned adjacent the inlet.

10. A heat exchange system, comprising:

a working fluid operable to absorb heat;

a fluid path comprising a conduit through which the working fluid flows;

a triboelectric charging element positioned along the fluid path so that the working fluid flows over a surface of the charging element, wherein the charging element is formed of a material having a triboelectric working function that is substantially different than the triboelectric working function of the working fluid, wherein the working fluid is triboelectrically charged by flowing over the charging element; and an insulating element positioned adjacent the charging element wherein the insulating element is formed of a material having a triboelectric working function that is similar to the triboelectric working function of the working fluid.

11. The heat exchange system of claim 10 wherein the charging element is formed of glass.

12. The heat exchange system of claim 10 wherein the charging element is formed of a non-metallic material.

13. A method for enhancing the performance of a working fluid in a vapor compression system, said method comprising the steps of:

compressing the working fluid to elevate the pressure and temperature of the working fluid;

discharging the working fluid to a condenser to release heat from the working fluid and convert the fluid to a liquid phase;

discharging the working fluid from the condenser to an expansion device to convert the working fluid to a vapor phase;

applying an electrical charge to the working fluid;

wherein the vapor compression system comprises a triboelectric element positioned along the fluid path of the working fluid and the step of applying an electric charge to the working fluid comprises the step of triboelectrically charging the working fluid;

positioning an insulating element adjacent the triboelectric element, wherein the insulating element is formed of a material that has a triboelectric working function that is similar to the triboelectric working function of the working fluid; and discharging the working fluid from the expansion device and transferring heat to the working fluid.

14. The method of claim 13 wherein the triboelectric element is formed of a material that has a substantially different triboelectric working function than the working fluid.

15. The method of claim 13 wherein the step of triboelectrically charging the working fluid comprises flowing the working fluid over a surface of the triboelectric element.

16. The method of claim 13 wherein the step of applying an electrical charge comprises applying an electrical charge to the working fluid as the working fluid flows along a fluid path between the expansion device and the compressor.

17. The method of claim 13 wherein the step of applying an electrical charge comprises the step of triboelectrically charging the working fluid.

18. The method of claim 17 wherein the step of triboelectrically charging the working fluid comprises flowing the working fluid over a surface of the triboelectric element.

19. The method of claim 13 wherein the vapor compression system comprises a conduit for carrying the working fluid and the method comprises grounding a portion of the conduit to dissipate the applied electrical charge.

20. A method for enhancing the performance of a working fluid in a vapor compression system comprising a conduit for carrying the working fluid, said method comprising the steps of:

compressing the working fluid to elevate the pressure and temperature of the working fluid;

discharging the working fluid to a condenser to release heat from the working fluid and convert the fluid to a liquid phase;

discharging the working fluid from the condenser to an expansion device to convert the working fluid to a vapor phase;

applying an electrical charge to the working fluid;

grounding a portion of the conduit to dissipate the applied electrical charge; and discharging the working fluid from the expansion device and transferring heat to the working fluid.

21. The method of claim 20 wherein the vapor compression system comprises a triboelectric element positioned along the fluid path of the working fluid and the step of applying an electric charge to the working fluid comprises the step of triboelectrically charging the working fluid.

22. The method of claim 20 wherein the step of applying an electrical charge comprises applying an electrical charge to the working fluid as the working fluid flows along a fluid path between the expansion device and the compressor.

23. A heat exchange system, comprising:

a working fluid operable to absorb heat;

a fluid path comprising a conduit through which the working fluid flows;

a triboelectric charging element positioned along the fluid path so that the working fluid flows over a surface of the charging element, wherein the charging element is formed of a material having a triboelectric working function that is substantially different than the triboelectric working function of the working fluid, wherein the working fluid is triboelectrically charged by flowing over the charging element; and a grounding element along the conduit to dissipate an electrical charge applied by the triboelectric charging element.

24. The vapor compression system of claim 23 comprising a fluid path through which the working fluid flows, wherein the charging element is positioned along the fluid path between an expansion valve and a compressor.

25. The vapor compression system of claim 23 wherein an evaporator positioned along the fluid path comprises an inlet and the charging element is positioned adjacent the inlet.

26. The heat exchange system of claim 23 wherein the charging element is formed of a non-metallic material.

* * * * *